US009938057B2

(12) United States Patent
Carsello et al.

(10) Patent No.: US 9,938,057 B2
(45) Date of Patent: Apr. 10, 2018

(54) PRESERVATION DEVICE

(71) Applicant: Sello, LLC., Western Springs, IL (US)

(72) Inventors: Cynthia Louise Carsello, Western Springs, IL (US); Frank Joseph Carsello, Western Springs, IL (US)

(73) Assignee: Sello, LLC, Western Springs, IL (US)

( * ) Notice: Subject to any disclaimer, the term of this patent is extended or adjusted under 35 U.S.C. 154(b) by 0 days.

(21) Appl. No.: 14/920,542

(22) Filed: Oct. 22, 2015

(65) Prior Publication Data

US 2016/0114945 A1 Apr. 28, 2016

Related U.S. Application Data

(60) Provisional application No. 62/067,871, filed on Oct. 23, 2014.

(51) Int. Cl.
*B65D 51/24* (2006.01)
*B65D 47/12* (2006.01)
(Continued)

(52) U.S. Cl.
CPC ..... *B65D 51/244* (2013.01); *B65D 33/00* (2013.01); *B65D 47/06* (2013.01); *B65D 47/12* (2013.01);
(Continued)

(58) Field of Classification Search
CPC .... B67D 3/0051; B65D 51/244; B65D 33/00; B65D 47/06; B65D 47/12; B65D 47/24;
(Continued)

(56) References Cited

U.S. PATENT DOCUMENTS 3,217,935 A * 11/1965 Burt ..... B65D 47/061 222/109
3,311,275 A * 3/1967 Gibson ..... B65D 47/043 222/489
(Continued)

FOREIGN PATENT DOCUMENTS

EP 0666076 1/1997
EP 0799773 11/1998
(Continued)

OTHER PUBLICATIONS

International Search Report and Written Opinion of PCT/US2015/056959, dated Jan. 18, 2016.
(Continued)

*Primary Examiner* — Nicholas J Weiss
*Assistant Examiner* — Andrew P Bainbridge
(74) *Attorney, Agent, or Firm* — Dunlap Codding, P.C.

(57) ABSTRACT

A preservation device are used to preserve liquids and other items, such as foodstuffs, which spoil when exposed to oxygen for a period of time. The preservation devices are configured to form an air tight seal when disposed on a bottle and/or a vessel. The devices include a container, and disposed within the container is an oxygen absorber, which removes oxygen remaining in the bottle or vessel after it is sealed by the preservation device. Either the container or the oxygen absorber has a gas permeable, liquid impermeable membrane. The preservation device may also include a flow control mechanism that enables a liquid to be dispensed from the bottle without requiring the removal of the entire stopper device from the bottle. The preservation device may alternatively include an air channel system to control the flow of the liquid to be dispensed from the bottle without requiring the removal of the entire stopper device from the bottle. Such arrangements enable the liquid to be dispensed
(Continued)

while only allowing a minimal amount of oxygen to enter the bottle, thus improving preservation.

33 Claims, 15 Drawing Sheets

(51) Int. Cl.

| | |
|---|---|
| ***B65D 33/00*** | (2006.01) |
| ***B65D 47/06*** | (2006.01) |
| ***B65D 47/24*** | (2006.01) |
| ***B65D 47/32*** | (2006.01) |
| *B65D 81/24* | (2006.01) |
| *B65D 81/26* | (2006.01) |
| *B65D 23/02* | (2006.01) |
| *B65D 81/28* | (2006.01) |

(52) U.S. Cl.
CPC ..... *B65D 47/24* (2013.01); *B65D 47/32* (2013.01); *B65D 81/268* (2013.01); *B65D 23/02* (2013.01); *B65D 51/24* (2013.01); *B65D 81/24* (2013.01); *B65D 81/245* (2013.01); *B65D 81/266* (2013.01); *B65D 81/267* (2013.01); *B65D 81/28* (2013.01)

(58) Field of Classification Search
CPC ..... B65D 47/32; B65D 47/121; B65D 47/241–47/247; B65D 23/02; B65D 51/24; B65D 81/24; B65D 81/245; B65D 81/266–81/268; B65D 81/28
USPC ..... 222/152, 478–489, 566–574; 220/212; 215/261, 227–228, 307–315
See application file for complete search history.

(56) References Cited

U.S. PATENT DOCUMENTS

| | | | | | |
|---|---|---|---|---|---|
| 3,693,847 | A * | 9/1972 | Gibson | B65D 47/122 | 215/DIG. 1 |
| 3,926,348 | A * | 12/1975 | Lutzker | B65D 41/28 | 222/189.07 |
| 3,951,812 | A | 4/1976 | Hsu | | |
| 3,966,099 | A * | 6/1976 | Sanford, Jr. | B67D 3/00 | 222/478 |
| 4,287,995 | A * | 9/1981 | Moriya | B65D 47/242 | 215/228 |
| 4,421,235 | A * | 12/1983 | Moriya | B65D 47/242 | 206/439 |
| 4,756,436 | A | 7/1988 | Morita et al. | | |
| 4,856,650 | A * | 8/1989 | Inoue | A23L 3/3436 | 206/204 |
| 5,042,698 | A * | 8/1991 | Fessell | B65D 47/26 | 141/294 |
| 5,092,914 | A * | 3/1992 | Cullen | A23L 3/3418 | 426/124 |
| 5,799,836 | A * | 9/1998 | Lee | B65D 47/06 | 222/189.07 |
| 6,274,209 | B1 | 8/2001 | Pagidas et al. | | |
| 6,331,333 | B1 * | 12/2001 | Wu | B65D 81/268 | 252/188.28 |
| 6,482,452 | B1 * | 11/2002 | Weller | A23B 4/20 | 206/204 |
| 6,508,955 | B1 | 1/2003 | DelDuca et al. | | |
| 6,709,724 | B1 * | 3/2004 | Teumac | B65D 81/266 | 206/204 |
| 6,845,887 | B1 * | 1/2005 | Granger | B65D 47/043 | 222/153.06 |
| 6,986,807 | B2 * | 1/2006 | Brunk | B01D 53/0415 | 206/204 |
| 7,032,943 | B1 | 4/2006 | Marler | | |
| 7,628,284 | B2 | 12/2009 | Hurley et al. | | |
| 8,011,540 | B1 * | 9/2011 | Peckels | B01F 3/04099 | 222/190 |
| 8,091,746 | B2 * | 1/2012 | Gotler | B65D 25/48 | 215/41 |
| 9,033,187 | B2 * | 5/2015 | Luebke | B01F 3/0446 | 222/190 |
| 9,758,666 | B2 * | 9/2017 | Itoh | C08L 53/02 | |
| 2008/0272085 | A1 | 11/2008 | Laporta | | |
| 2011/0011820 | A1 | 1/2011 | Park et al. | | |
| 2011/0186536 | A1 * | 8/2011 | Wurster | B65D 51/1616 | 215/307 |
| 2011/0278256 | A1 | 11/2011 | Suh | | |
| 2013/0306654 | A1 * | 11/2013 | Frenzel | B65D 33/00 | 220/592.01 |
| 2014/0319179 | A1 * | 10/2014 | Bazoberry | A23L 2/44 | 222/152 |
| 2015/0217912 | A1 | 8/2015 | Luzaich | | |
| 2015/0251822 | A1 * | 9/2015 | Slevin | G01F 11/265 | 222/570 |

FOREIGN PATENT DOCUMENTS

| | | |
|---|---|---|
| EP | 2727993 | 5/2014 |
| FR | 3000476 | 7/2014 |
| JP | 2005132475 | 5/2005 |
| JP | 201168403 | 4/2011 |
| JP | 201193570 | 5/2011 |
| JP | 5059979 | 10/2012 |
| KR | 10-2012-0064737 | 6/2012 |
| WO | WO 02/40368 | 5/2002 |

OTHER PUBLICATIONS

USPTO Office Action regarding U.S. Appl. No. 15/134,094 dated May 19, 2017, 16 pages.

* cited by examiner

PRESERVATION DEVICE

CROSS REFERENCE TO RELATED APPLICATIONS/INCORPORATION BY REFERENCE STATEMENT

The present patent application incorporates by reference the entire provisional patent application identified by U.S. Ser. No. 62/067,871 filed on Oct. 23, 2014, and claims priority thereto under 35 U.S.C. 119(e).

FIELD OF THE INVENTION

The present disclosure generally relates to devices for preserving liquids and other items that are spoiled when exposed to oxygen for a period of time.

BACKGROUND OF THE DISCLOSURE

Most potable liquids and foodstuffs have a limited shelf life, and upon being opened are exposed to air (oxygen), which causes the item to quickly expire. Wine, in particular, has four primary causes of spoliation: oxidation, bacteria, heat, and light. Wine is extremely sensitive to oxygen and begins oxidizing immediately upon contact with oxygen. While some exposure to oxygen may be desirable, particularly with respect to red wines, too much exposure will cause the wine to become rancid.

Generally, food and beverage manufacturers use three primary means, vacuum packaging, gas flushing, or active packaging, to preserve their products and extend shelf life. Generally, active packaging, also referred to as modified atmosphere packaging ("MAP"), preserves foods and beverages by using oxygen absorbers and/or desiccants to modify the atmosphere within a package. Oxygen absorbers reduce oxygen levels, preventing oxidation. Desiccants reduce equilibrium relative humidity ("ERH") to reduce microbial and bacterial spoilage. The spoilage of food and beverages is most commonly the result of oxidation and/or bacterial spoilage.

The three primary options of preservation are used very commonly commercially among food manufacturers, but to a lesser extent at the consumer level. Vacuum and gas flushing require commercial equipment to be executed effectively. Active packaging requires oxygen absorbers/desiccants that are typically packaged in bulk bags of hundreds to thousands of units that become active once opened, which makes them useful to high volume food and beverage manufacturers when the products are packaged, but not to consumers.

Active packaging is considered the most effective technology for preservation because it is able to incorporate both oxygen and ERH reduction, which is not possible with vacuum and gas flushing. Oxygen absorbers lower oxygen levels more effectively than any other preservation method and are extremely cost effective. Studies show oxygen absorbers will lower oxygen levels to under 0.01% in most applications. On the other hand, gas flushing or vacuum sealing can typically reduce oxygen levels to 1 to 5% if executed with commercial equipment.

Regarding potable liquids, devices to preserve wine and other liquids have been on the market for some time. Most of these devices focus on preservation by vacuuming, gassing, or reducing the amount of air within the headspace. For example, one device is disposed in a container that holds a liquid such as juice, milk, or wine. The device includes a cartridge that floats on the top of the liquid to reduce the air volume in the headspace. A shortcoming of this device is that the cartridge sits on the liquid itself, which may be visually unpleasant to consumers or effect the flavor or fragrance of the liquid. Another shortcoming is that to dispense the liquid, the container must be opened, which introduces a large amount of air into the container. A further shortcoming is that the cartridge may fall out of the container when the liquid is dispensed, which may cause the cartridge to break or become contaminated, or it may simply be off-putting to consumers.

Another device includes a cap for a bottle containing a liquid such as wine. The cap has a compartment for storing an oxygen absorber. The compartment includes one or more vents that enable air to enter the compartment, but not the liquid. One shortcoming of this type of device is that in order to pour the liquid the cap must be removed from the bottle. This introduces a significant amount of air into the bottle, which the oxygen absorber may not remove quickly enough to prevent oxidation of the liquid in the bottle.

Another device includes a cap assembly for use with a wine bottle and an oxygen absorber that hangs from the cap assembly via a fixing device. A shortcoming of this device is that the oxygen absorber is able to come in direct physical contact with the wine stored in the bottle, which may not only be visually off putting to a consumer, but may also affect the flavor, color, or fragrance of the wine. Another shortcoming of this device is that cap assembly must be removed in order for the wine to be dispensed, thereby introducing a large amount of air into the bottle, which may not be absorbed quickly enough or overwhelm the oxygen absorber. Another shortcoming is that it does not cause humidity reduction.

Another device uses a latex balloon that is inserted into an open wine bottle. Air is then pumped into the balloon, which causes the balloon to expand and create a seal on top of the wine. A major shortcoming of this device is that the balloon sits on the wine itself, which is not only visually unpleasant to consumers, but also effects the flavor of the wine. Another shortcoming is that the balloon needs to be removed from the bottle when the wine is to be dispensed, which introduces a large amount of air into the bottle. Further shortcomings are that the balloon slowly deflates over time thereby allowing oxygen to interact with the wine, and that the balloons break after repeated use and are relatively expensive to purchase.

Another device uses a vacuum comprising specialized rubber stoppers and a pump that is used to suck the air out of the bottle. Still another device dispenses an inert gas such as nitrogen into the wine bottle to expel the air. A shortcoming of both of these devices is that they are expensive and complicated to use. Another shortcoming of both devices is that the act of pouring requires the preservation device to be removed, which results in an influx of new air into the bottle which then has to be removed by re-introducing the inert gas into the bottle or by pumping out the new air. Further shortcomings with respect to the vacuum device are that the device fails to achieve 80%, let along 95% or 100%, removal of oxygen from the container, and a change in pressure caused by the vacuum alters the fragrance or flavor of the remaining wine.

As noted above a major shortcoming of the existing devices is that in order to pour the liquid (e.g., wine) stored in a bottle or container, the bottle must be opened (usually by removing the preservation device itself from the bottle), which introduces a significant amount of fresh air (oxygen) into the bottle. This is problematic because the oxygen absorber will not be able to remove the newly introduced oxygen quickly enough to prevent the new oxygen from interacting with the liquid. In addition, the introduction of a significant amount of fresh air will cause the oxygen absorber to expire more quickly, either before all of the newly introduced oxygen is absorbed or soon thereafter, which will result in the liquid spoiling before it is completely consumed. Further shortcomings of the aforementioned devices are that they alter the flavor or fragrance of the liquid, are expensive, do not adequately remove oxygen from the container, are not easy to use, and/or are not visually appealing to consumers.

SUMMARY OF THE DISCLOSURE

In one aspect, a preservation device for use with a bottle having a neck is disclosed. The preservation device includes an upper member having a first side and a second side, opposite the first side, and a lower member, disposed adjacent the second side of the upper member. The lower member is configured to fit within the neck of the bottle. At least one sealing member extends around an outer surface of the lower member. The at least one sealing member substantially prevents the flow of liquid or air into or out of the bottle when the lower member is disposed within the neck of the bottle. The stopper device also includes an attachment member that is disposed on the lower member at an end distal to the upper member and a container for holding an oxygen absorber. The container is configured to mate with the attachment member. The container has at least one side wall that has at least one aperture and a membrane attached to the at least one side wall and extending across the at least one aperture.

In another aspect, a preservation device for a bottle having a neck is disclosed. The preservation device includes an upper member having a first side and a second side, opposite the first side, and a bore extending through the upper member. A flow control mechanism is connected to the upper member for opening and closing the bore. A lower member is disposed adjacent the second side of the upper member. The lower member is configured to fit within the neck of the bottle. At least one sealing member extends around an outer surface of the lower member for substantially preventing the flow of liquid or air into or out of the bottle when the lower member is disposed within the neck of the bottle. At least one inlet is disposed on the lower member below the sealing member. The inlet is configured to allow the flow of a liquid or air into the lower member and is in communication with the bore. The preservation device also includes an attachment member that is disposed on the lower member at an end distal to the upper member and a container for holding an oxygen absorber. The container is configured to mate with the attachment member. The container has at least one side wall that has at least one aperture and a membrane. The membrane is attached to the at least one side wall and extends across the at least one aperture.

In a further aspect, a preservation device for use with a vessel having an opening is disclosed. The preservation device includes a cap that has a first side and a second side, opposite the first side. The cap is configured to cover the opening of the vessel. A sealing member is configured to extend around the opening of the vessel and fit within an inner surface of the second side of the cap. The sealing member substantially prevents the flow of liquid or air into or out of the vessel when the sealing member together with the cap are disposed on the vessel. The preservation device also includes an attachment member disposed on the second side of the cap and a container for holding an oxygen absorber. The container is configured to mate with the attachment member. The container has at least one side wall that has at least one aperture and a membrane. The membrane is attached to the at least one side wall and extends across the at least one aperture.

In another aspect, a preservation device for use with a vessel is disclosed. The preservation device includes a container for holding an oxygen absorber and is configured to fit within the vessel. The container has an orifice, at least one side wall having at least one aperture, and a membrane. The membrane is attached to the at least one side wall and extends across the at least one aperture. The preservation device also includes a removable top that is configured to mate with the orifice of the container. The preservation device further includes a first attachment member and a second attachment member for removably attaching the container to the vessel. The first attachment member is disposed adjacent a surface of the container, and the second attachment member is configured to connect with the first attachment member.

In another aspect, a preservation device for a bottle having a neck is disclosed. The preservation device includes a first member having at least a flange, and a tube configured to fit within the neck of the bottle. The preservation device also includes a second member disposed adjacent to the distal end of the tube opposite the flange. The second member is configured to fit within the neck of the bottle. At least one sealing member extends around an outer surface of the first member. The at least one sealing member substantially prevents the flow of liquid or air into or out of the bottle when the first member is disposed within the neck of the bottle. The preservation device also includes an attachment member that is disposed on the second member at an end distal to the first member and a container for holding an oxygen absorber/desiccant canister. The container is configured to mate with the attachment member.

DETAILED DESCRIPTION

Generally, a preservation device is used to preserve liquids and other items, such as foodstuffs, which spoil or expire when exposed to oxygen for a period of time. The preservation device is configured to form an air tight seal when disposed on a bottle or vessel. The devices include a container that may preferably have an gas permeable, liquid impermeable membrane. Disposed within the container is an oxygen absorber, which removes oxygen remaining in the bottle or vessel after it is sealed by the sealing member of the preservation device. The preservation device may include a flow control mechanism that enables the liquid or other foodstuff to be dispensed from the bottle or vessel without requiring the removal of the entire preservation device from the bottle/vessel. Such arrangement enables the liquid/foodstuff to be dispensed while only allowing a minimal amount of oxygen to enter the bottle, which improves preservation qualities of the system as the oxygen absorber will more readily be capable of quickly absorbing the lesser amount of oxygen newly introduced into the vessel. Similarly, the preservation device may include a sealable bore that enables the removal of contents stored within the vessel without requiring the removal of the entire preservation device from the vessel, thereby minimizing the amount of oxygen that enters the vessel when the contents are dispensed.

While the different embodiments described below are discussed in relation to the preservation of potable liquids and foodstuffs, the disclosed devices are not limited to the preservation of such items. The preservation devices taught by the present disclosure may be used with any liquid or item that spoils, corrodes, or is otherwise rendered unusable for its intended purpose when exposed to oxygen for a period of time. For example, the devices disclosed below may be used with pharmaceutical preparations.

As used herein, the terms first, second, third, and the like are used to distinguish between similar elements and not necessarily for describing a specific sequential or chronological order. The terms are interchangeable under appropriate circumstances and the embodiments of the invention can operate in other sequences than described or illustrated herein.

In addition, the terms top, bottom, front, rear, left, right, upper, lower, and the like as used herein are used for descriptive purposes and not necessarily for describing specific positions. The terms so used are interchangeable under appropriate circumstances and the embodiments described herein can operate in orientations other than described or illustrated herein.

Figure 1:
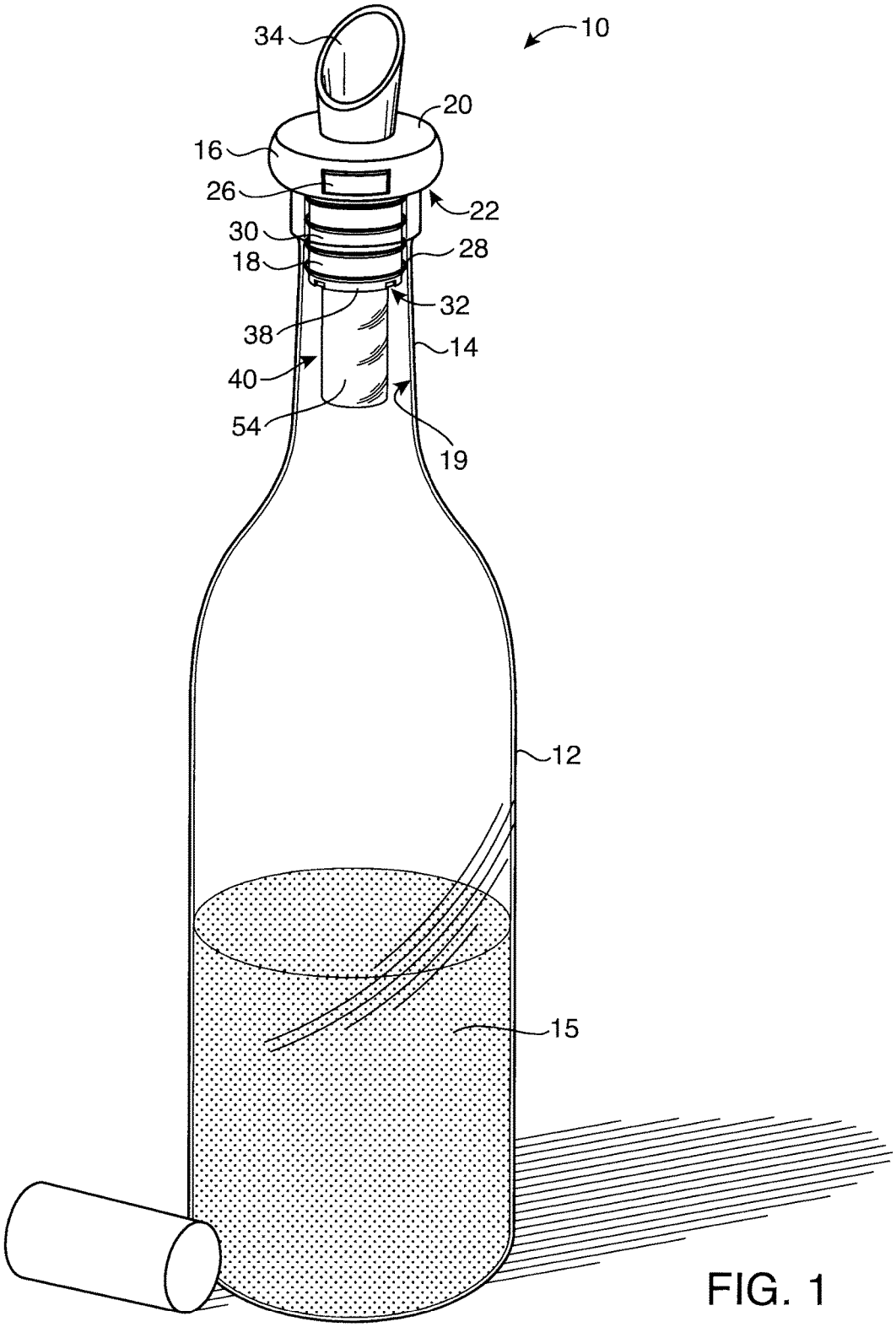
FIG. 1 is an isometric view of an embodiment of a preservation device disposed within a bottle having a neck where the bottle is in an upright position.
Figure 2:
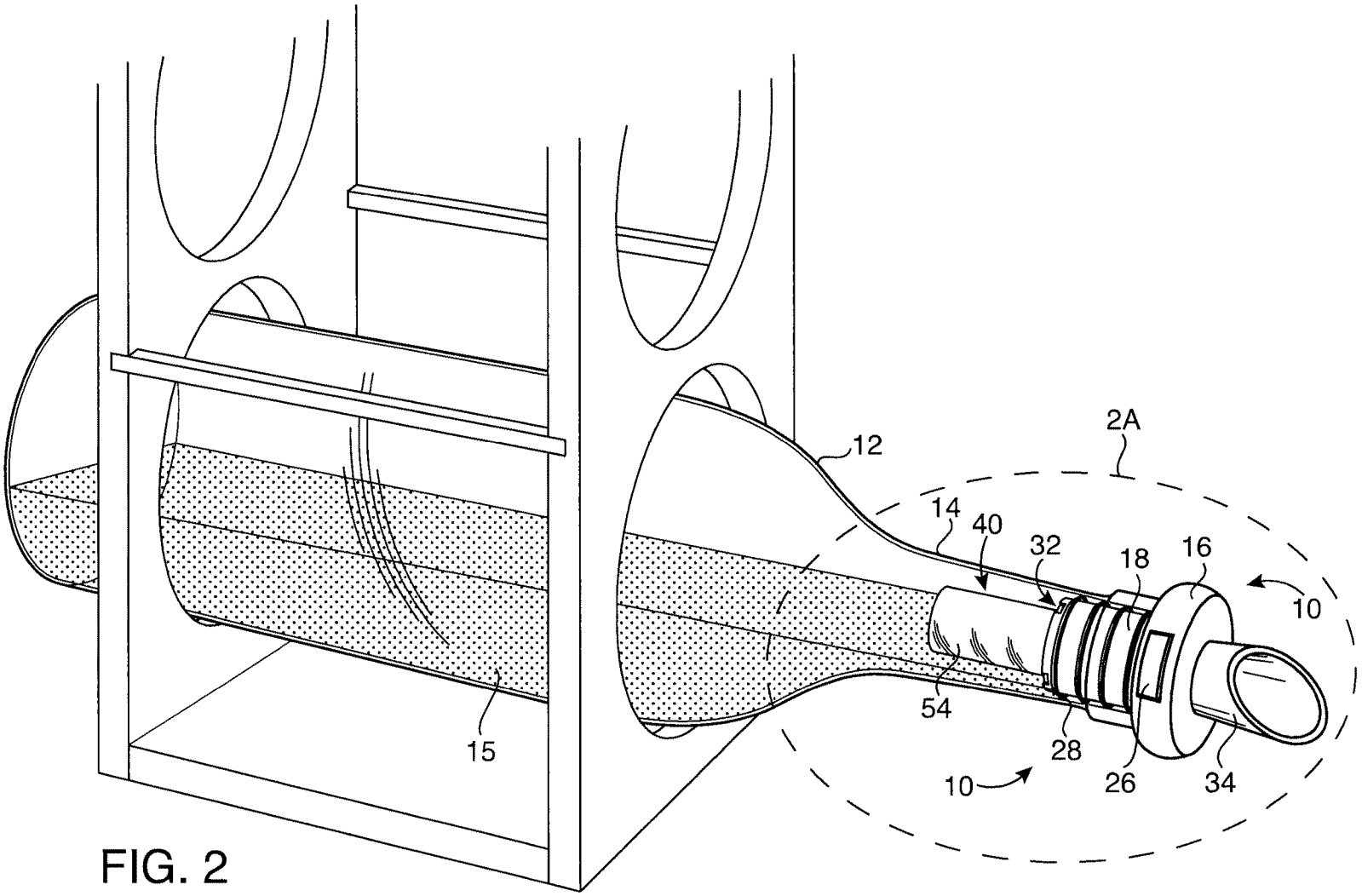
FIG. 2 is an isometric view of the embodiment of a preservation device of FIG. 1 disposed within a bottle that has been disposed in a substantially horizontal position.
Figure 2A:
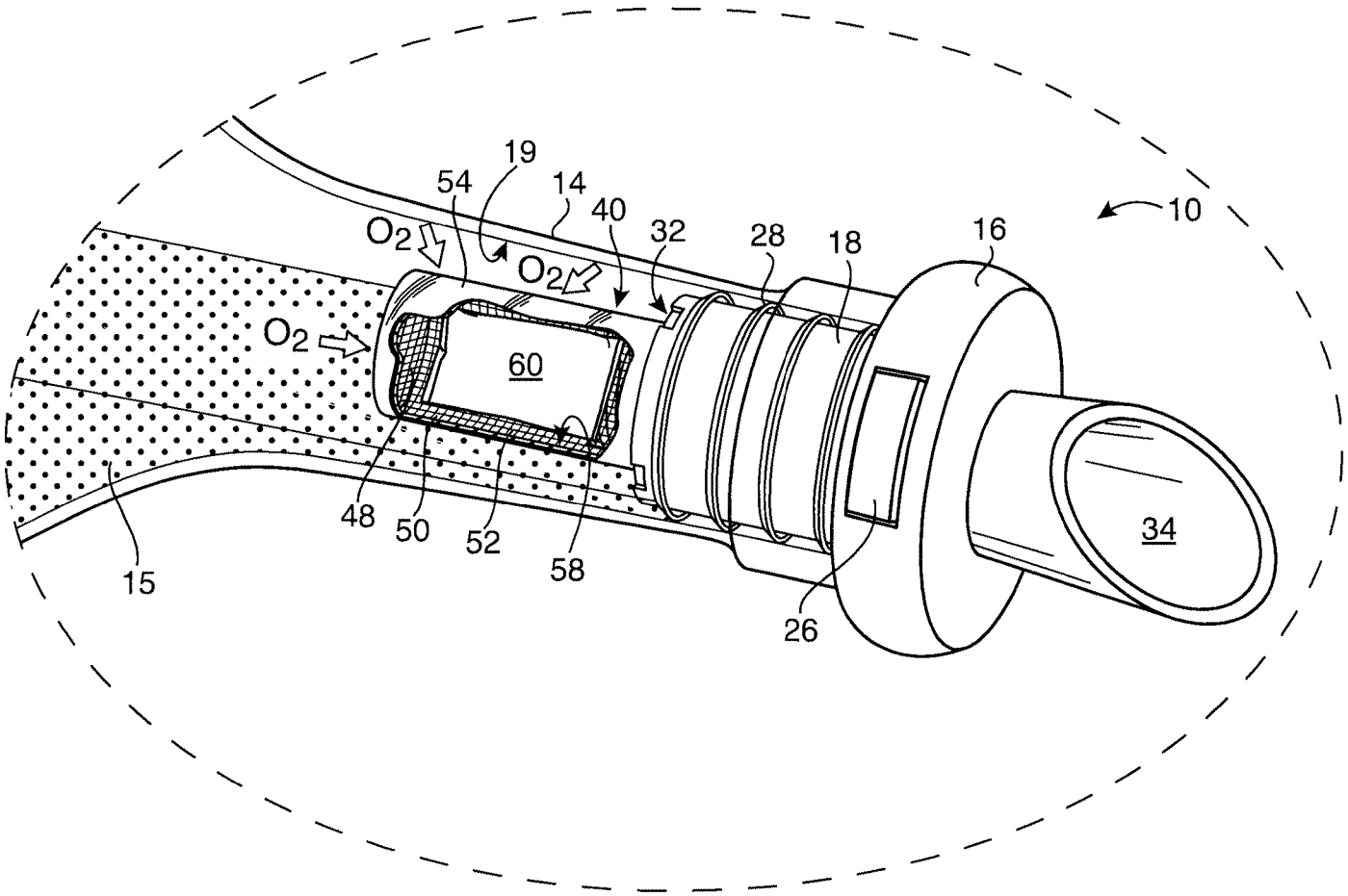
FIG. 2A is close up view of the preservation device of FIG. 2 and includes a fragmentary view of a container portion of the preservation device that has an oxygen absorber disposed therein. Block arrows illustrate the movement of oxygen ($O_2$) in the container toward the oxygen absorber.
Figure 3:
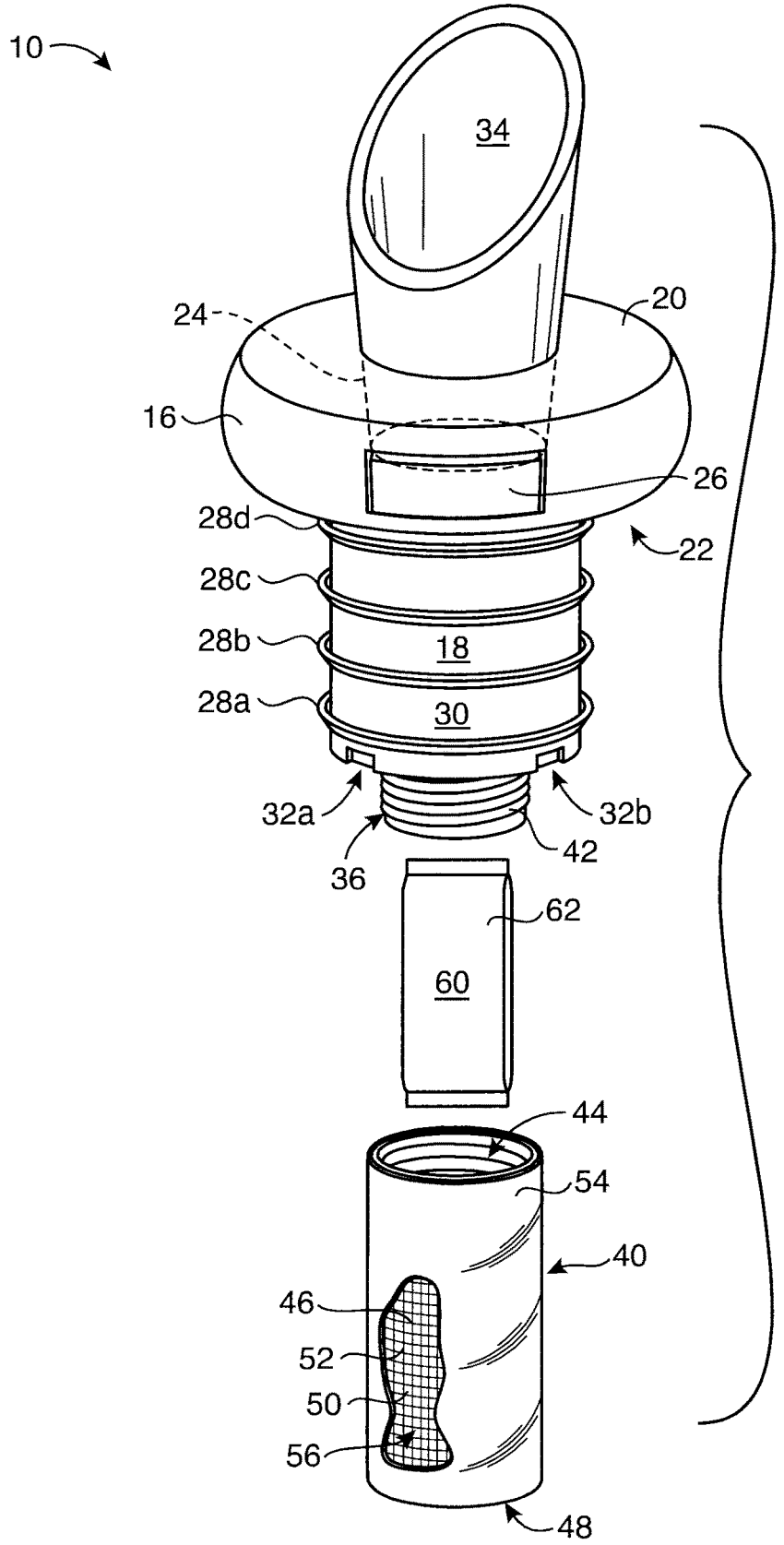
FIG. 3 is an exploded view of the preservation device of FIG. 2.

Turning to the figures in which like reference numbers indicate like parts throughout, FIGS. 1-3 show an illustrative embodiment of a preservation device 10. The preservation device 10 may be used with a bottle 12 that has a neck 14, such as a wine bottle. The preservation device 10, however, is not limited to use with a bottle; the preservation device 10 may be used with any container having an elongated opening or neck. A liquid 15 (e.g., wine) is disposed within the bottle 12. While a liquid 15 is shown in FIGS. 1-2A, a solid or semi-solid item may also be disposed within the bottle 12 in addition to the liquid 15 or in lieu of the liquid 15.

The preservation device 10 includes an upper member 16 and a lower member 18. The upper member 16 and lower member 18 may be formed from a material such as rubber, plastic, metal, metal alloy (e.g., stainless steel), and the like or any combination thereof. The upper member 16 may be substantially disk-shaped (as shown in FIG. 1), rectangular-shaped, triangular-shaped, star-shaped or any other suitable shape, and has a diameter or width that is greater than the diameter of an inner surface 19 of the neck 14 of the bottle 12. The lower member 18 is of a size and shape that enables lower member 18 to fit within the neck 14 of the bottle 12. The lower member 18 may have a cylindrical shape (as shown in FIG. 1), rectangular shape, triangular shape, star shape, or any other suitable shape, and has a diameter or width that is only sufficiently smaller than the diameter of the inner surface 19 of the neck 14 of the bottle 12 to allow substantially close-fitting insertion of the lower member 18 into the neck 14 of the bottle 12.

The upper member 16 has a first side 20 and a second side 22, which is opposite to the first side 20. As best illustrated in FIG. 3, a bore 24 extends through the upper member 16 from the first side 20 to the second side 22. The lower member 18 is disposed adjacent the second side 22 of the upper member 16. In the illustrative example of FIG. 3, the lower member 18 is centered about the bore 24.

A flow control mechanism 26 may be connected to the upper member 16 and used to open and close the bore 24. The flow control mechanism 26 may be a check valve or a manually controlled valve, which may be controlled by a press button (as shown in FIG. 1), a lever, or a switch, for example.

The preservation device 10 may also include a sealing member 28 that extends around an outer surface 30 of the lower member 18. The sealing member 28 engages the inner surface 19 of the neck 14 of the bottle 12, which prevents the flow of liquid or air into or out of the bottle 12 when the lower member 18 of the stopper device 10 is disposed within the neck 14 of bottle 12. One or more sealing members 28 may be disposed on the lower member 18. For example, as shown in the illustrative example of FIG. 3, four annular sealing members 28*a*, 28*b*, 28*c*, 28*d* may be disposed on lower member 18. Alternatively, the lower member 18, itself, may be configured to engage the inner surface 19 of the neck 14 of the bottle 12 to substantially prevent the flow of liquid or air into or out of the bottle 12 when the lower member 18 is disposed within the neck 14, in which case sealing member 28 need not be included. While the sealing member 28 or the lower member 18, each respectively, substantially prevent the flow of liquid/oxygen into or out of the bottle 12, the upper member 16 may be used as an additional liquid or air barrier by disposing the second side 22 of the upper member 16 against the portion of the neck 14 that defines an opening of the bottle 12 as best shown in FIGS. 1-2A.

An inlet 32 that is in communication with the bore 24 may be disposed on the lower member 18 below the sealing member 28. One or more inlets may be used, each of which is in communication with the bore 24. In the illustrative examples of FIG. 1-3, two inlets 32*a* and 32*b* are shown. If the lower member 18 includes one or more sealing members 28, then the inlet 32 is located below the sealing member 28 that is disposed furthest from the upper member 16. For example, in the illustrative example of FIG. 3, the sealing member 28 furthest from the upper member 16 is sealing member 28*a*, and the two inlets 32*a* and 32*b* are located below sealing member 28*a*.

The inlet 32 is configured to allow the flow of liquid into the lower member 18 and through the bore 24 when the bottle 12 is sufficiently tilted to enable the liquid 15 to exit the bottle 12. The preservation device 10 may additionally include a pour spout 34 that is attached to the first side 20 of the upper member 16 and centered about the bore 24. Thus, in the illustrative example of FIG. 1, when the bore 24 is opened by the flow control mechanism 26 and the bottle 12 is sufficiently tilted, the liquid 15 flows into the inlets 32*a* and 32*b*, through the lower member 18, into the bore 24, and out of the pour spout 34.

As best shown in the illustrative example of FIG. 3, an attachment member 36 is disposed on an end 38 of the lower member 18 that is distal to the upper member 16. The attachment member 36 is used to attach a container 40 to the lower member 18 of the preservation device 10. In one embodiment, the container 40 is configured to mate with the attachment member 36. For example, in the illustrative example of FIG. 3, the attachment member 36 has a first set of screw threads 42 and the container 40 has a second set of screw threads 44. The first set of screw threads 42 are female and the second set of screw threads 44 are male so that the first set of screw threads 42 mate with the second set of screw threads 44 and vice versa. Although the embodiment of FIG. 3 shows the use of mating screw threads, any attachment mechanism may be used to attach the container 40 to the lower member 18 including, but not limited to, a mechanical fastener, hinge, tether, hook and eye, clasp, and/or snap fit.

The container 40 includes a side wall 46 and may also include a bottom wall 48 as shown in FIG. 2A. The side wall 46 may include one aperture 50 or a plurality of apertures 50 and may be formed from plastic, metal, metal alloy (e.g., stainless steel), or any other liquid and food safe material. The bottom wall 48 may also include one or more apertures 50. In the illustrative embodiment shown in FIG. 2A, the side wall 46 is a mesh with a plurality of apertures 52. While the container 40 shown in the illustrative examples of FIGS. 1-3 is shown as having a cylindrical shape, the container 40 may also have a rectangular shape, cone shape, triangular shape, star shape, or any other suitable shape. Depending on the shape of the container 40, the container 40 may include one or more side walls 46 that each has a specific shape. For example, in the illustrative embodiments of FIGS. 1-3, the container 40 includes a single side wall 46 that is cylindrically shaped. However, the container 40 may alternatively include, for example, four rectangular shaped side walls and a rectangular shaped bottom wall (not shown).

The container 40 may preferably include a membrane 54. The membrane 54 may be comprised of a material that is air permeable and liquid impermeable. One such material could be, for example, Kevlar. The membrane 54 is attached to the side wall 46 and extends across the one or more apertures 50. In the illustrative examples of FIGS. 2 and 2A, the membrane 54 extends around the entirety of an exterior surface 56 of the side wall 46 (mesh 52 as shown in FIG. 2A) and the bottom wall 48. However, the membrane 54 may also extend around the entirety of an interior surface 58 of the side wall 46 and the bottom wall 48, or the membrane 54 may only extend across a portion of the side wall 46 or bottom wall 48 on either the interior or exterior surfaces of each.

The container 40 is used to house an oxygen absorber 60. The oxygen absorber 60 may be in a form of a sachet 62 (as shown in FIGS. 2A and 3), a tablet, packet, or a strip that includes an oxygen absorbing material such as iron.

Figure 4:
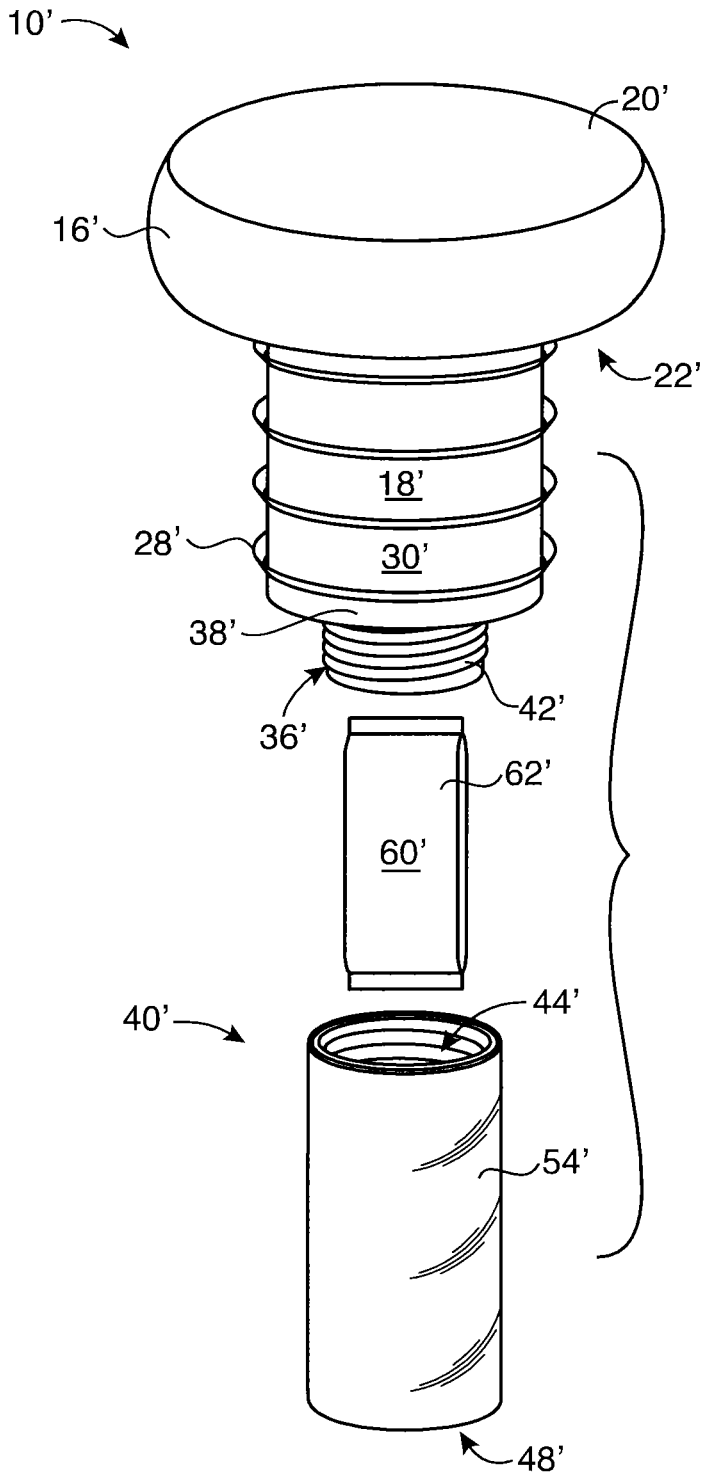
FIG. 4 is an exploded view of a further embodiment of a preservation device that does not include a pour spout, a flow control mechanism, or an inlet.

Turning to FIG. 4, another embodiment of the preservation device 10 is shown as preservation device 10'. The stopper device 10' of FIG. 4 does not include a bore 24, a flow control mechanism 26, an inlet 32, or a pour spout 34. Thus, air or liquid cannot flow into or through the lower member 18' or the upper member 16' of the stopper device 10'. With the exception of these differences, the preservation device 10' includes the same components and configurations, and operates in the same manner as preservation device 10 discussed above with respect to FIGS. 1-3.

Figure 10:
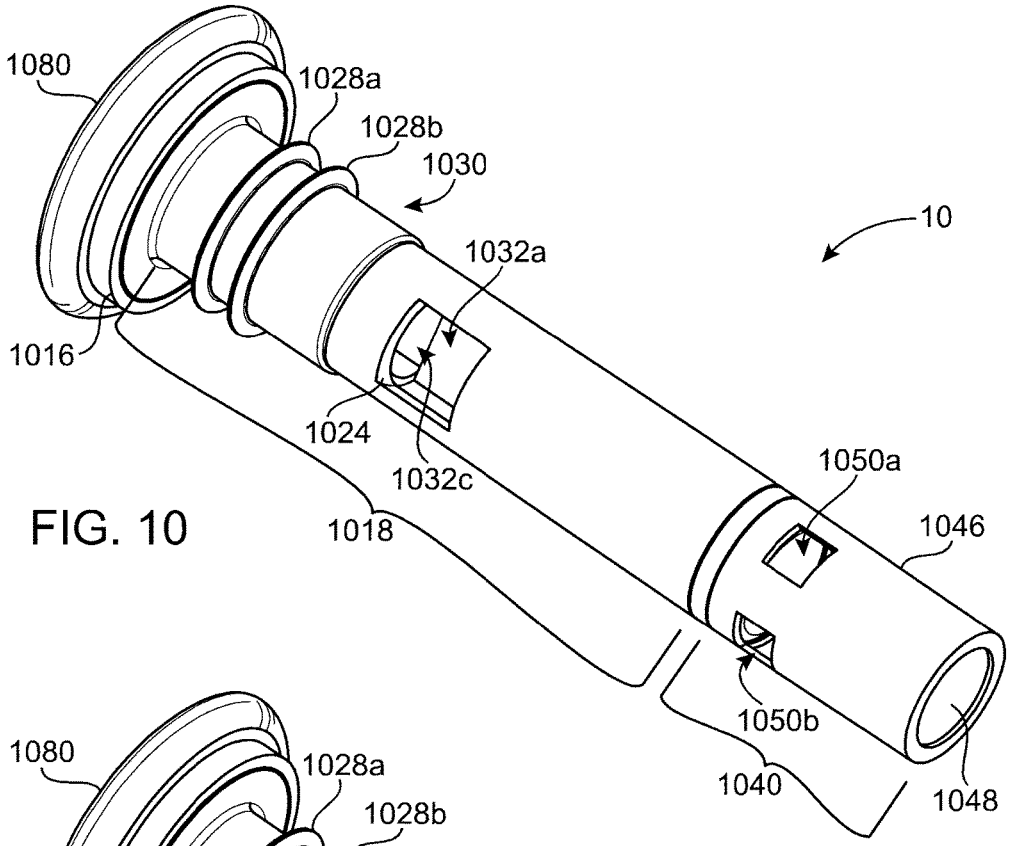
FIG. 10 is an isometric view of another embodiment of a preservation device.
Figure 11:
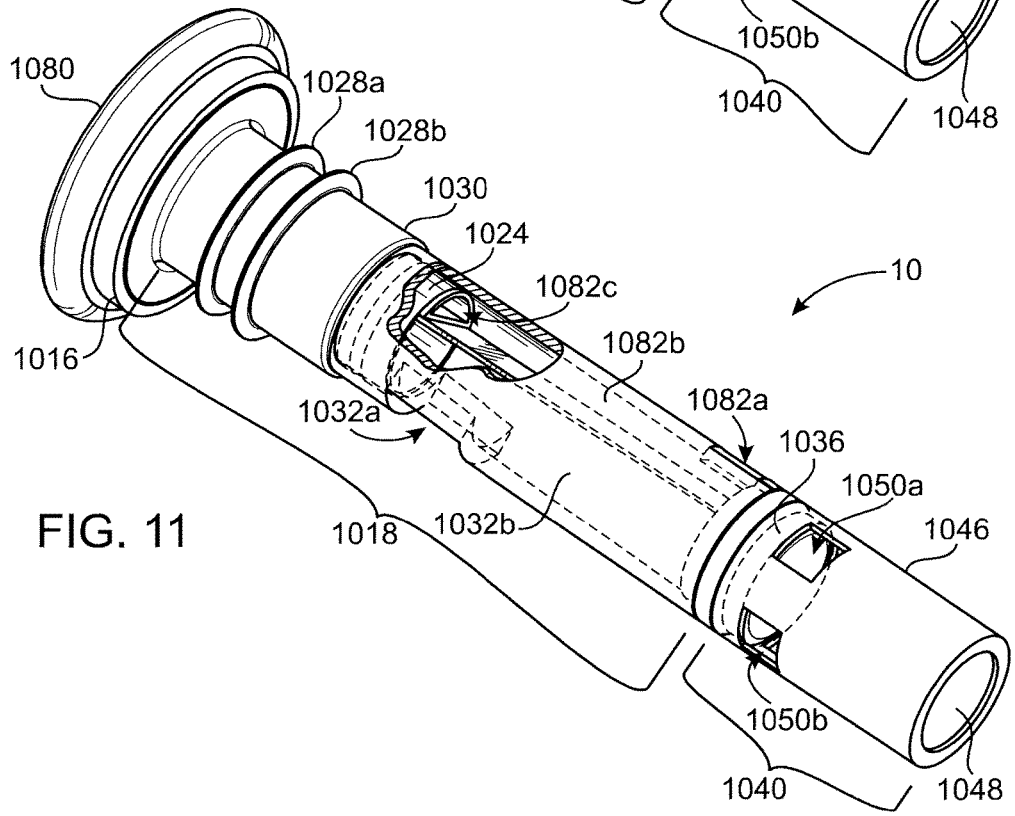
FIG. 11 is a partial cross-sectional view of the preservation device and vessel of FIG. 10.
Figure 12:
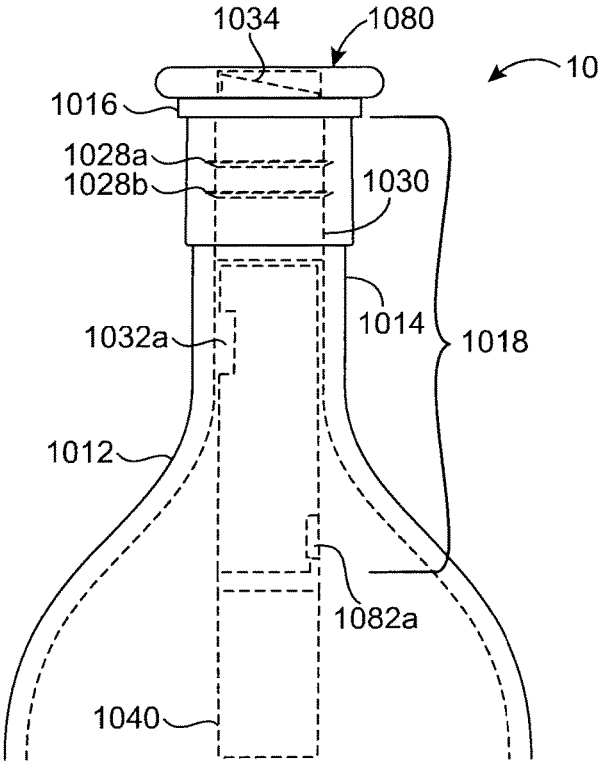
FIG. 12 is a partial cross-sectional view of the preservation device and vessel of FIG. 10 disposed within a bottle having a neck.
Figure 13:
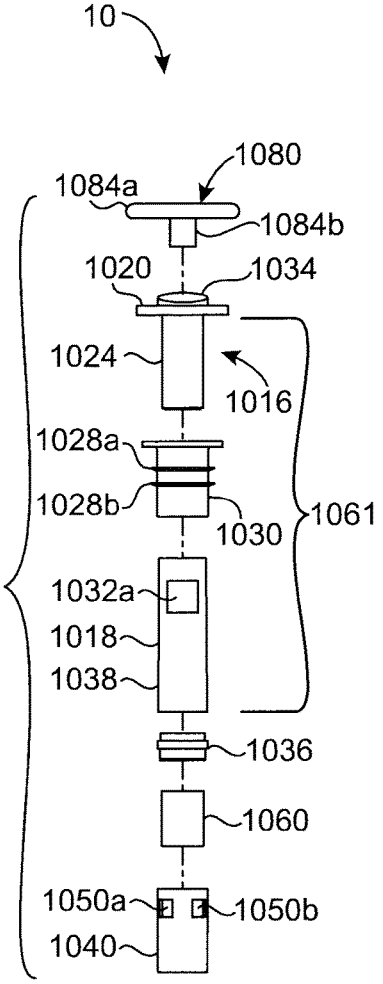
FIG. 13 is an exploded view of the preservation device of FIG. 10.

FIGS. 10-17 show another illustrative embodiment of a preservation device 10. As shown in FIG. 12, the preservation device 10 may be used within a bottle 1012 that has a neck 1014, such as a wine bottle. As illustrated in FIGS. 10-12, the preservation device 10 may be made up of four main parts: a first member 1016, a second member 1018, a container 1040, and a lid 1080. The first member 1016, second member 1018, and container 1040 may be formed and shaped as discussed above. The lid 1080 may be formed from a material such as rubber, plastic, metal, metal alloy (e.g., stainless steel), and the like or any combination thereof. The lid 1080 may be substantially disk-shaped (as shown in FIGS. 10 and 11), rectangular-shaped, triangular-shaped, star-shaped or any other suitable shape. As shown in FIG. 13, the lid 1080 has a flat side 1084*a* and may have a stem 1084*b* having a diameter or width that is smaller than the diameter of pour spout 1034 such that the stem at least fits within, if not substantially seals, the pour spout 1034 to prevent the flow of liquid out and air in. The first member 1016 has a flange 1020 that preferably has a diameter or width that is greater than the diameter of most sizes of commercial bottles. The first member 1016 further comprises a tube 1024 that has an outer diameter that enables the tube 1024 to fit within the neck of most commercial bottles.

As shown in FIGS. 10-13, the preservation device 10 may also include a seal support member 1030 having an inner diameter (see FIG. 16) that is dimensioned to fit at least snuggly over the outer diameter of tube 1024 (of first member 1016). As illustrated in FIG. 12, seal support 1030 provides additional width to first member 1016 such that it may have the same outer diameter as the outer diameter of second member 1018. In another embodiment, the first and second members may have the same outer diameter and the inner diameter and length of the seal support member 1030 may be dimensioned such that the seal support member 1030 may provide at least some stabilization to the connection between first member 1016 and second member 1018. In all embodiments having a seal support member, the seal support member 1030 preferably has an outer diameter dimensioned to fit within the neck of at least one type of commercial bottle and preferably within the neck of the majority of bottles used commercially, especially for wine. The seal support member 1030 has extending around its outer surface one or more sealing members 1028*a* and 1028*b*, which engage the inner surface of the neck of the bottle to substantially prevent the flow of liquid or air into or out of the bottle when the tube 1024 and seal supporting member 1030 are disposed within the neck of the bottle. As illustrated in other embodiments, instead of using a seal support member 1030 it would be possible to affix the sealing members 1028 directly to the tube 1024 of first member 1016.

Figure 14:
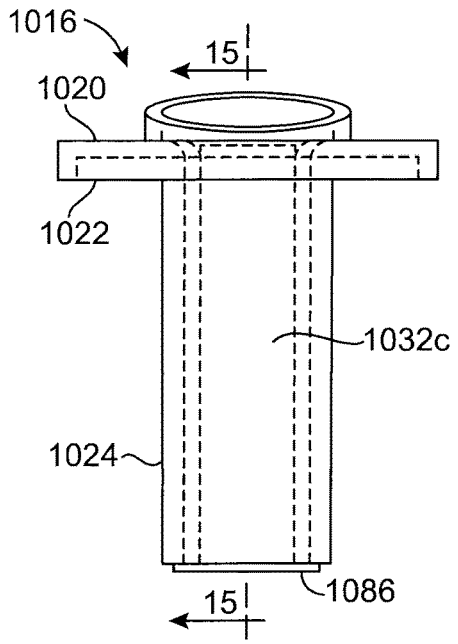
FIG. 14 is a cross-sectional view of the upper member 1016 of the preservation device of FIG. 10.
Figure 15:
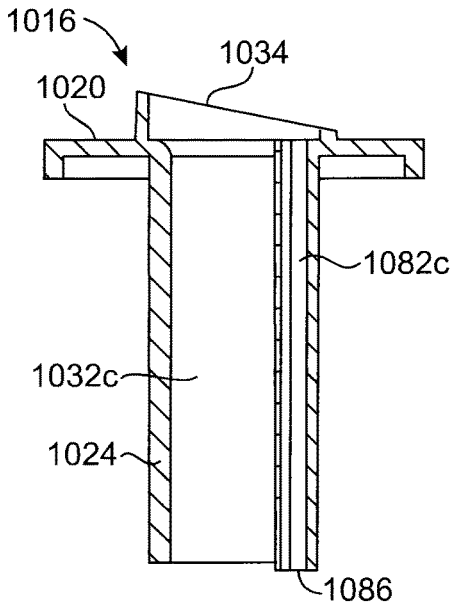
FIG. 15 is a cross-sectional view of the upper member 1016 of FIG. 14 taken along sight line 15-15.
Figure 16:
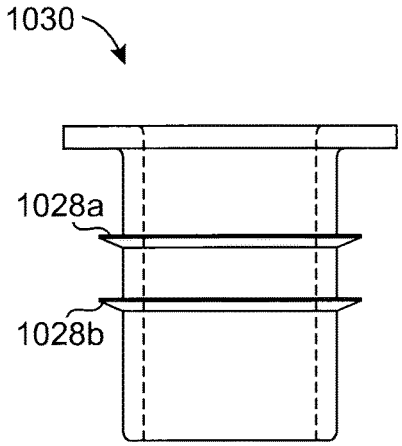
FIG. 16 is a partial cross-sectional view of the seal support member 1030.
Figure 17:
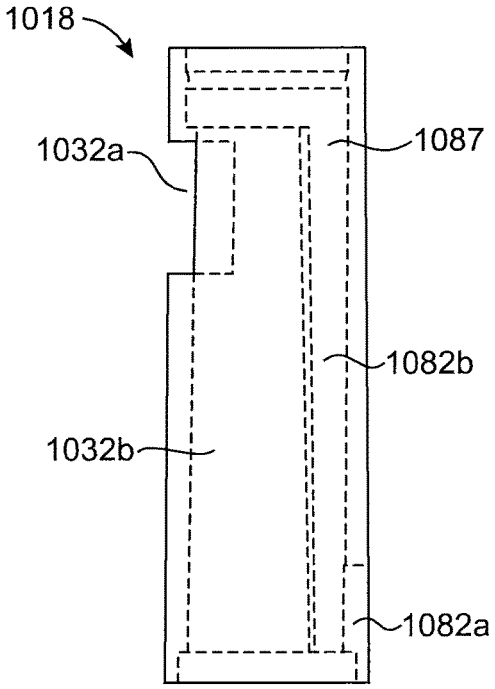
FIG. 17 is a cross-sectional view of the lower member 1018 of the preservation device of FIG. 10.

As best illustrated with FIGS. 11, 14, 15 and 17, within the preservation device 10 there are two fluid channels: a liquid channel 1032 and an air channel 1082. The liquid channel 1032 extends from at least liquid inlet 1032*a* (disposed in the side wall of the second member 1018) to the pour spout 1034. The air channel 1082 similarly extends from an air vent 1082*a* (disposed in the side wall of second member 1018, at a location separated laterally and longitudinally from the fluid inlet 1032*a*) to the pour spout 1034. The liquid channel 1032 is formed by the connection of second liquid channel 1032*b* (FIG. 17) to first liquid channel 1032*c* (FIG. 15) whereas the air channel 1082 is formed by second air channel 1082*b* (FIG. 17) to first air channel 1082*c* (FIG. 15). In the embodiment illustrated by FIGS. 10-17, key 1086 (FIG. 15) is used to ensure that both first and second fluid channels are oriented correctly for proper connection. In particular, as shown in FIG. 11, the key 1086 fits into the top of the second air channel (a key hole 1087) completing the physical connection of the air channel 1082 and resulting in alignment of first and second liquid channels 1032*b* and 1032*c*.

FIGS. 10 and 11 reflect that the preservation device 10 may also include a container 1040 that is connected to the end of the second member 1018 distal to the first member 1016. The container 1040 may be connected to the second member 1018 by an attachment member 1036. The container 1040 has at least a side wall 1046 which may include one or more apertures (e.g. 1050*a*, 1050*b*), and a bottom wall 1048 which may also include one or more apertures. As shown in FIG. 13, the container 1040 may house an oxygen absorber/desiccant canister 1060. In this embodiment of FIGS. 10-17, the oxygen absorber/desiccant canister 1060 is preferably food grade or higher. The oxygen absorber/desiccant canister 1060 may be made of high-density polyethylene ("HDPE") or some other suitable material. The oxygen absorber/desiccant canister 1060 must be gas permeable on at least one side. The oxygen absorber/desiccant canister 1060 canister may be water impermeable, which allows it to be used with both foods and beverages. The oxygen absorber/desiccant canister 1060 may be individually packaged to facilitate consumer purchase, storage and later use. The individual packaging preferably consists of flexible packaging that carries a near 100% gas and vapor barrier, and has an expected shelf life of one year. An example of a suitable oxygen absorber/desiccant canister 1060 canister is the StabilOX® sold by Multisorb Technologies of Buffalo, N.Y.

The preservation device 10 may also include a pour spout 1034, which is preferably centered on the flange and is in fluid connection with the fluid channel 1032 and the air channel 1082 within the tube 1024. As shown in FIGS. 14 and 15, the pour spout 1034 is preferably cowl-shaped to facilitate substantially controlled pouring of liquid out of the fluid channel 1032. The pour spout 1034 is preferably dimensioned to also allow air into the air channel 1082. The pour spout 1034 may be of a shallow height to avoid significantly increasing the height of the bottle 1012 due to the insertion of the preservation device 10. In one embodiment, the maximum height of the pour spout 1034 may be 0.14 inches and slope down to a maximum height of 0.03 inches. In the same embodiment, the inner diameter of the pour spout may be 0.55 inches, while the outer diameter of the spout may be 0.63 inches. The air inlet in the pour spout may be a maximum width of the air inlet may be 0.09 inches.

The embodiment of FIGS. 10-17 can be thought of having an upper member comprising the portions of first member 1016 that sit on top of or above the top of the bottle. This would include at least flange 1020 and pour spout 1034. This embodiment can also be thought of as having a lower member 1061, which comprises the portions of the first member 1016 that sit within the neck of the bottle (including but not limited to the tube 1024) as well as seal supporting member 1030, and second member 1018.

Figure 5:
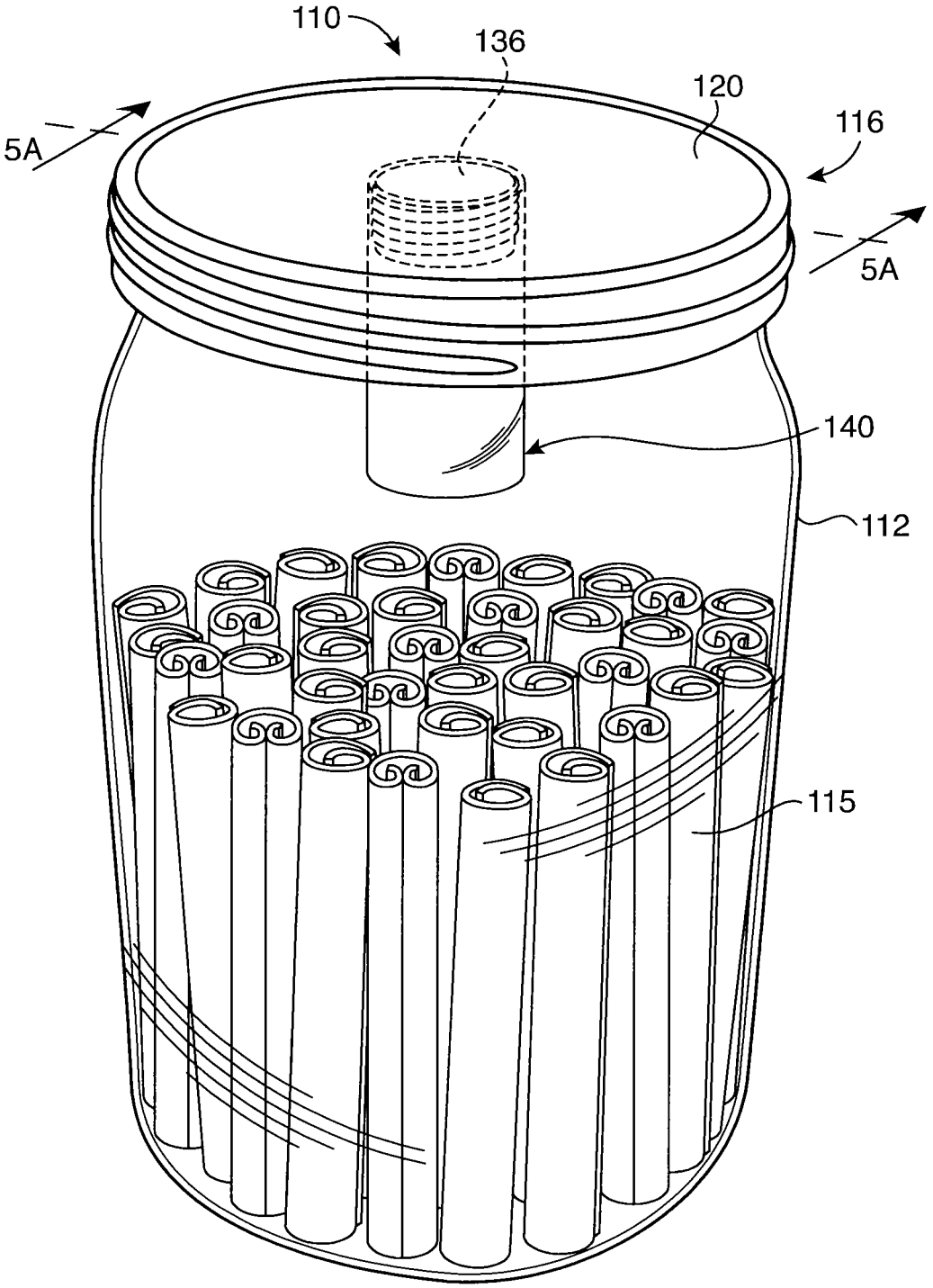
FIG. 5 is an isometric view of a preservation device disposed within a vessel.
Figure 5A:
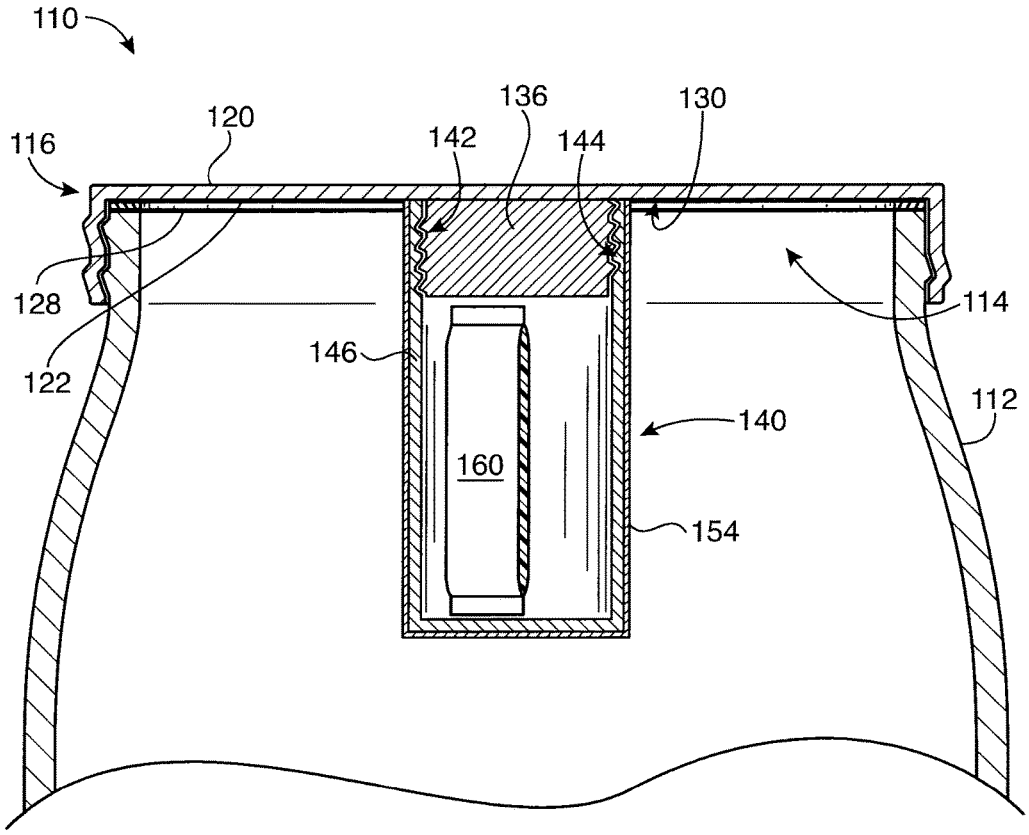
FIG. 5A is a partial cross-sectional view of the preservation device and vessel of FIG. 5.

Turning to FIGS. 5 and 5A, a preservation device 110 is shown in connection with a vessel 112 having an opening 114. The vessel includes contents 115, and may be, for example, a storage container made from glass, metal, metal alloy (e.g., stainless steel), or plastic. The contents 115 may be perishable foodstuffs as shown in the illustrative example of FIG. 5. The preservation device 110 includes a cap 116 that has a first side 120 and a second side 122, opposite the first side 120. The cap 116 is of a suitable size and shape to cover the opening 114 of the vessel 112. The cap 116 is removably attached to the vessel 112 via, for example, a screw fit, snap fit, clasp, hinge, or fastener. The cap 116 may be a single component as shown in FIGS. 5 and 5A or the cap 116 may be comprised of two separate components (not shown) an inner member that covers the opening 114, and an outer member that attaches the inner member to the vessel 112.

The preservation device 110 also includes a sealing member 128. The sealing member 128 extends around the opening of the vessel 112 and fits within an inner surface 130 of the second side 122 of the cap 116. The sealing member 128 may be separate from the cap 116 or the sealing member 128 may be attached to the inner surface 130 of the cap 116 via an adhesive or the like. The sealing member 128 substantially prevents the flow of liquid or air into or out of the vessel 112 when the sealing member 128 together with the cap 116 are disposed on the vessel 112.

Figure 5B:
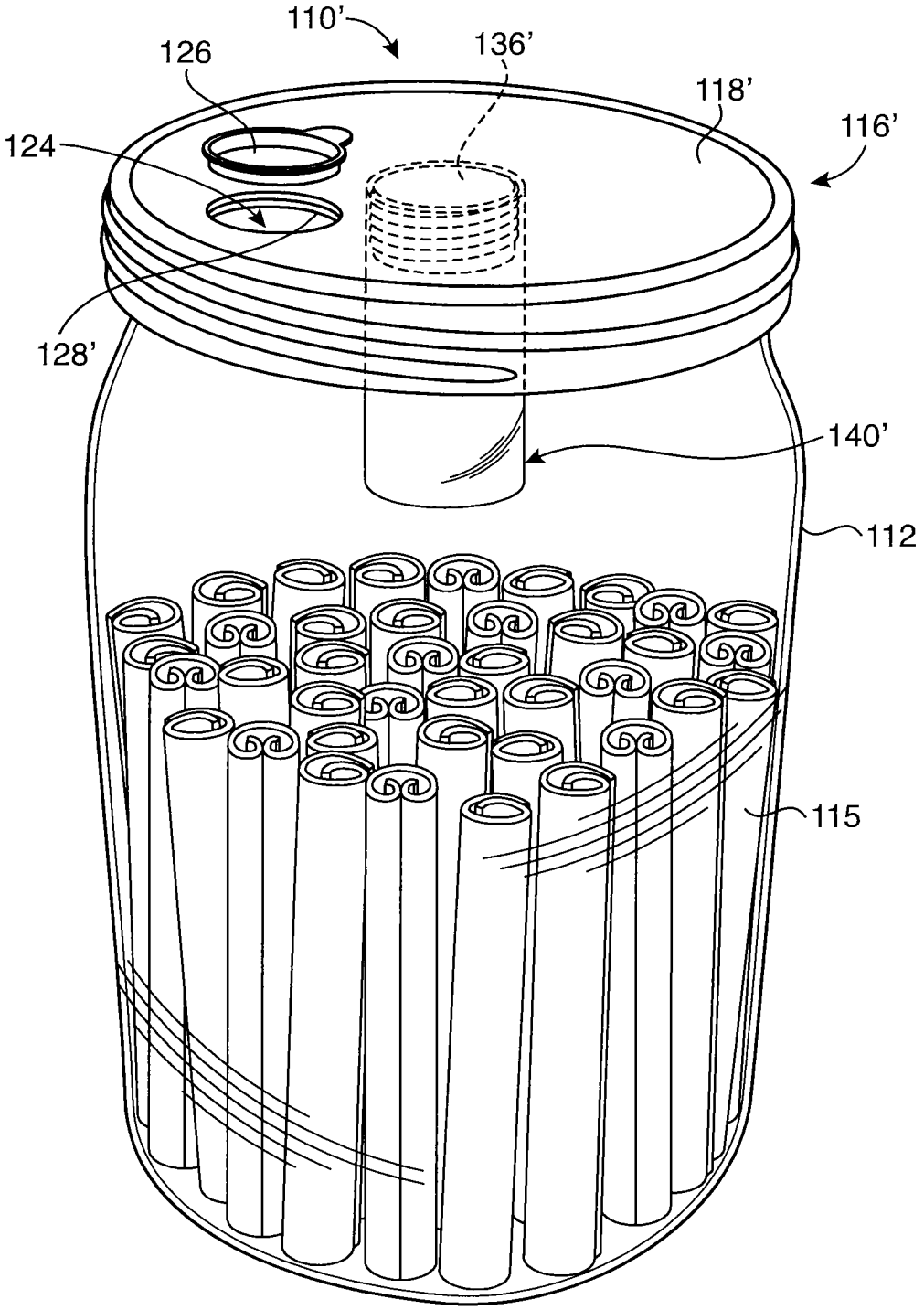
FIG. 5B is an isometric view of another embodiment of the preservation device of FIGS. 5 and 5A that includes a bore and a lid.

The preservation device 110 also includes an attachment member 136 that is disposed on the second side 122 of the cap 116. While the illustrative examples of FIGS. 5 and 5B show the attachment member 136 disposed at a center point of the cap 116, the attachment member 136 also may be disposed on the cap 116 at a point that is off center. The attachment member 136 is used to attach a container 140 to the cap 116 of the preservation device 110. In one embodiment, the container 140 is configured to mate with the attachment member 136. For example, as shown in FIG. 5B, the attachment member 136 has a first set of screw threads 142 and the container 140 has a second set of screw threads 144. The first set of screw threads 142 are female and the second set of screw threads 144 are male so that the first set of screw threads 142 mate with the second set of screw threads 144 and vice versa. Though the embodiment of FIG. 5A shows the use of mating screw threads, any attachment mechanism may be used to attach the container 40 to the lower member 18 including, but not limited to, a fastener, hinge, hook and eye, clasp, and a snap fit. It should also be understood where the size of the vessel 112 allows and it would be desirable to more quickly absorb the oxygen by including a second attachment mechanism (not depicted) and container 140.

The container 140 is used to house an oxygen absorber 160. As noted above with respect to the oxygen absorber 60, the oxygen absorber 160 may be in a form of a sachet 162 (as shown in FIG. 5A), a tablet, packet, or a strip that includes an oxygen absorbing material. The container 140 has the same components and configurations, and operates in the same manner as the container 40 discussed above with respect to FIGS. 1-3. Therefore, further explanation of container 140 is not provided herein.

Another embodiment of the preservation device 110 is shown in FIG. 5B. In this embodiment, a preservation device 110' includes a cap 116' that has a bore 124. The bore 124 is smaller than the opening 114 of the vessel 112, but of a sufficient size and shape to enable access to the contents 115 of the vessel 112. A removable lid 126 or a closable pour spout (not shown) that is configured to form an air tight seal with the bore 124 may be attached to the cap 116 in order to close the bore 124 and prevent liquid or air from unintentionally entering or exiting the vessel 112 through the bore 124. The inclusion of a bore 124 and a removable lid 126 or closable pour spout eliminates the need to remove the entire cap 116' from the vessel 112 in order to access the contents 115, thereby minimizing the amount of air that enters the vessel 112 when the contents 115 are removed. Except for the addition of the bore 124 and the lid 126, the cap 116' includes the same components and configurations, and operates in substantially the same manner as preservation device 110 discussed above with respect to FIGS. 5 and 5A.

Figure 6:
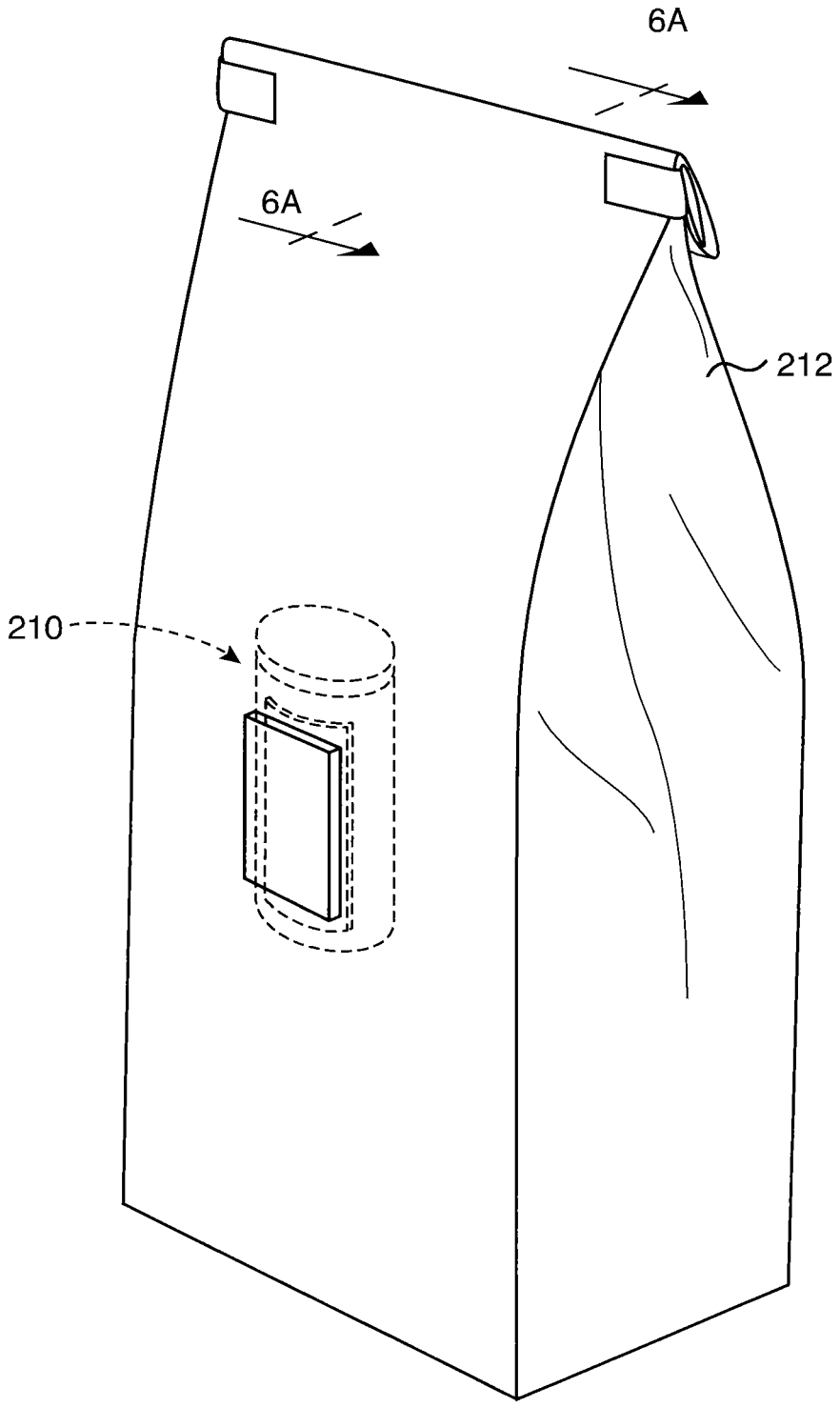
FIG. 6 is an isometric view of another embodiment of a preservation device disposed on a vessel in the form of a re-closable bag.
Figure 7:
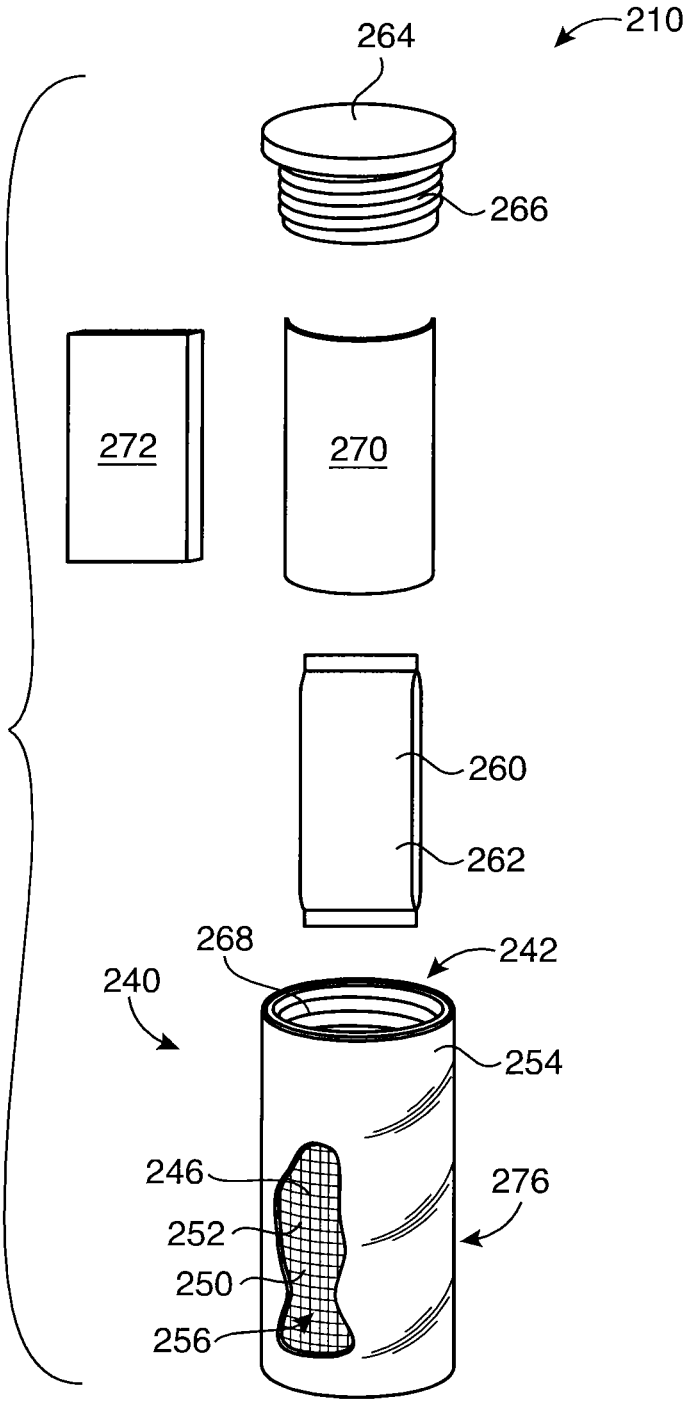
FIG. 7 is an exploded view of the preservation device of FIG. 6.

Referring to FIGS. 6-7, another embodiment of a preservation device 210 for use with a vessel 212 is shown. The vessel 212 includes an interior portion 214, an inner wall 216, and an outer wall 218. The vessel 212 may be, for example, a container or storage bag made from plastic, metal, metal alloy, or glass. The preservation device 210 is of a size and shape that enables the preservation device 210 to pass through an opening of the vessel 212 and fit within the interior portion 216 of the vessel 212.

Figure 6A:
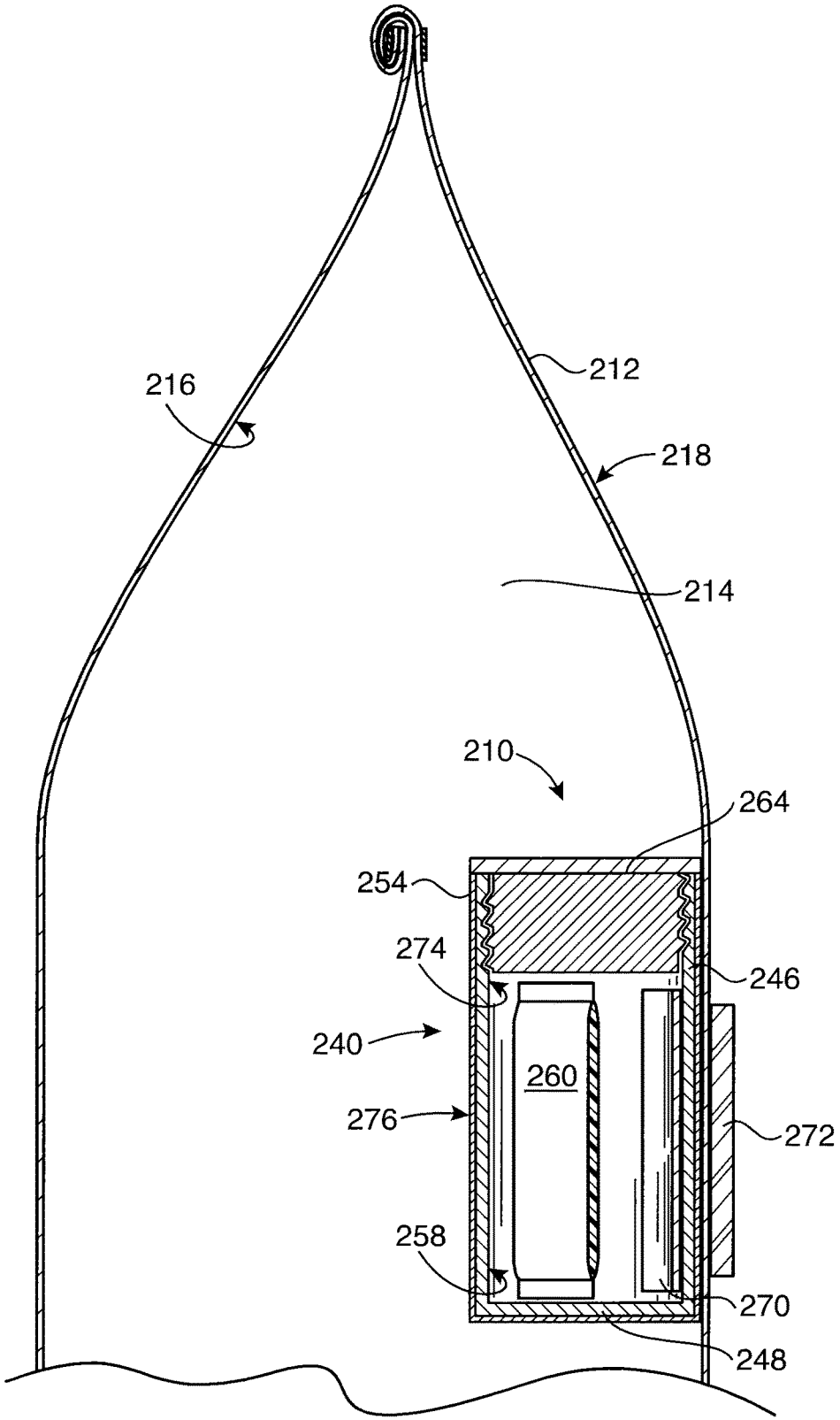
FIG. 6A is a cross sectional view partial view of the preservation device of FIG. 6.

The preservation device 210 includes a container 240 that has an orifice 242 as best seen in the illustrative example of FIG. 7. The container 240 also has at least one side wall 246 that defines a portion of the orifice 242. The container 240 may also include a bottom wall 248 as best seen in FIG. 6A.

The side wall 246 as well as the bottom wall 248 may include one aperture 250 or a plurality of apertures 250 (as best seen in FIG. 7) and be formed from plastic, metal, metal alloy (e.g., stainless steel), or any other suitable material. The container 240 may have a cylindrical shape as shown in the illustrative examples of FIGS. 6-7, or the container 240 may have a rectangular shape, cone shape, triangular shape, star shape, or any other suitable shape. Depending on the shape of the container 240, the container 240 may include one or more side walls 246. For example, as best shown in the illustrative example of FIG. 7, the container 240 includes a single side wall 246 that is a cylindrically shaped mesh 252. However, the container 240 may alternatively include, for example, four rectangular shaped side walls and a rectangular shaped bottom wall.

The container 240 may also include a membrane 254. The membrane 254 may be comprised of a material that is air permeable and liquid impermeable such as, for example, Kevlar, eVent®, or Gore-Tex®. The membrane 254 is attached to the side wall 246 and/or the bottom wall 248 and extends across the one or more apertures 250. As best seen in FIGS. 6A and 7, the membrane 254 may extend around the entirety of an exterior surface 256 of the side wall 246 and bottom wall 248. However, the membrane 254 may also extend around the entirety of an interior surface 258 of the side wall 246 and/or bottom wall 248. Alternatively, the membrane 254 may only extend across a portion of the side wall 246 or bottom wall 248 on either the interior or exterior surfaces of each.

The container 240 is used to house an oxygen absorber 260 as best seen in the illustrative example of FIG. 7. The oxygen absorber 260 may be in a form of a sachet 262, a tablet, packet, or a strip that includes an oxygen absorbing material such as iron.

The preservation device 210 also includes a removable top 264 that is configured to mate with the orifice 242 of the container 240. The removable top 264 enables the loading, removal, and exchange of oxygen absorbers 260 from the container 240. In the illustrative example of FIG. 7, the removable top 264 has a first set of screw threads 266 and the container 240 has a second set of screw threads 268. The first set of screw threads 266 are female and the second set of screw threads 268 are male so that the first set of screw threads 266 mate with the second set of screw threads 268 and vice versa. Although the embodiment of FIG. 7 shows the use of mating screw threads, any mechanism may be used to attach the top 264 to the container 240 including, but not limited to, a fastener, hinge, tether, hook and eye, clasp, and a snap fit.

The preservation device 210 also includes a first attachment member 270 and a second attachment member 272. The first and second attachment members 270, 272 removably attach the container 240 to the vessel 212 so that the container 240 can be removed and reused with other vessels. The first attachment member 270 is disposed adjacent a surface of the container 240. For example, the first attachment member 270 may be a free standing insert as shown in the illustrative examples of FIGS. 6-7, or the first attachment member 270 may be attached to the interior side 274 of the container 240 or to an exterior side 276 of the container 240. The first attachment member 270 may be attached to a surface (i.e., interior side 274 or exterior side 276) of the container 240 by an adhesive, soldering, or any other suitable attachment means. Alternatively, the first attachment member 270 may be integrally formed with or attached to the removable top 264. In this way the top 264 and first attachment member 270 are one component, which, among other things, would minimize the chance of losing the first attachment member 270 if the first attachment member 270 is removed from the container 240 to load or change out an expired oxygen absorber, for example.

The second attachment member 272 is configured to connect with the first attachment member 270. The second attachment member 272 may also be a free standing component as shown in the illustrative example of FIGS. 6-7, or the second attachment member 272 may be attached to the inner wall 216 of the vessel 212.

In the illustrative examples of FIGS. 6 and 6A, the first attachment member 270 is comprised of a magnetic or ferromagnetic material such as stainless steel, and the second attachment member 272 is a magnet. The container 240 with a first attachment member 270, as well as an oxygen absorber 260, disposed therein is placed against the inner wall 216 of the vessel 212. The second attachment member 272 is placed against the outer wall 218 of the vessel 212 in the same location as the container 240 such that the first attachment member 270 is connected to and held in place by the second attachment member 272.

The first attachment member 270 and the second attachment member 272 may also be a hook and loop fastener such that the first attachment member 270 is a strip of hooks that is attached via an adhesive to the exterior side 276 of the container 240 and the second attachment member 272 is a strip of loops that is attached to the inner wall 216 of the vessel 212. The first attachment member 270 (hook fastener) could then be mated to the second attachment member 272 (loop fastener) so that the container is disposed adjacent the inner all 216 of the vessel 212.

Alternatively, the preservation device 210 may only have a first attachment member 270. The first attachment member 270 may be attached to the removable top 264 or the exterior side 276 of the container 240. The first attachment member 270 in this embodiment is capable of connecting to the inner wall 216 of vessel 212 without the need for a second attachment member. For example, the vessel 212 may be a storage bag having flexible side walls and the first attachment member 270 may be a clip that can clip-on to the inner wall 216 of the vessel 212. Or, the first attachment member 270 may be a putty-like substance that attaches to the exterior side 276 of the container 240 and remains tacky so that container 240 can be stuck to the inner wall 216 of the vessel 212, removed from the vessel 212, and reattached to an interior wall of a different vessel.

Figure 8:
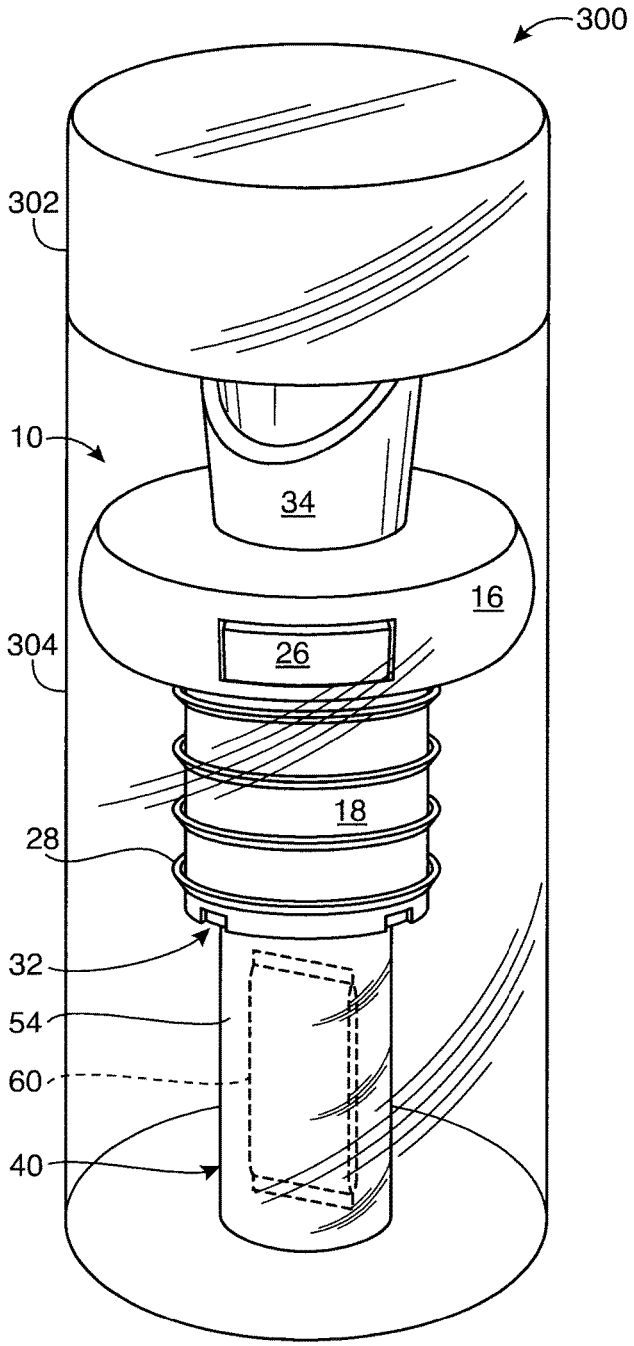
FIG. 8 is an isometric view of a storage device having a preservation device disposed therein.

Turing to FIG. 8, an embodiment of a storage device 300 is shown. The storage device 300 is used to store the stopper device 10, 10' when the stopper device 10, 10' is not in use. The storage device 300 includes a top portion 302 and a bottom portion 304. The top and bottom portions 302 and 304, respectively, may be formed of any material that is air and liquid impermeable such as glass, metal, metal alloy, plastic, and the like.

The top portion 302 is removably attached to the bottom portion 304. The top portion 302 may be attached to the bottom portion 304 via any attachment device that creates a substantially air tight seal between the top portion 302 and bottom portion 304. Examples of attachment devices that may be used include a tongue and groove joint, snap fit, screw threads, clasp, and the like. It is important that a substantially air tight seal is obtained when top portion 302 is placed on bottom portion 304 so that the amount of oxygen within the storage device 300 is minimized. That way any oxygen absorber 60, 60' contained within the container 40, 40' of the stopper 10, 10' is only exposed to a minimal amount of oxygen, which helps preserve the oxygen absorber for future use.

Figure 9:
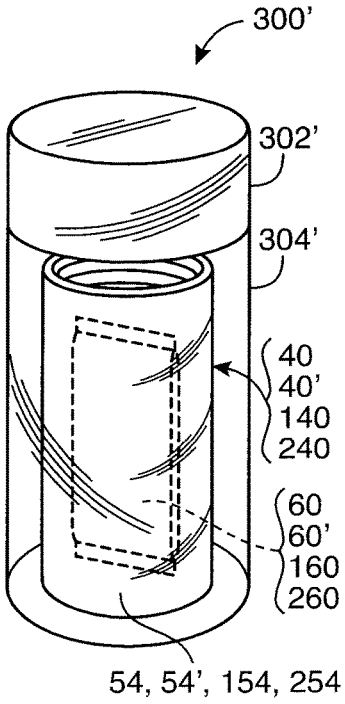
FIG. 9 is an isometric view of another embodiment of a storage device having a container disposed therein.

Referring to FIG. 9, another embodiment of a storage device 300' is shown. Like the storage device 300, the storage device 300' includes a top portion 302' and a bottom portion 304'. The top portion 302' is removably attached to the bottom portion 304' via any attachment device that creates a substantially air tight seal between the top portion 302' and the bottom portion 304'. Storage device 300' is the same as storage device 300 except that storage device 300' has a smaller size and volume than storage device 300. Storage device 300' is used to store only the container 40, 40', 140, 240. A smaller storage device is desirable to minimize the amount of air in the storage device 300' so that any oxygen absorber 60, 60', 160, 260 disposed within the container 40, 40', 140, 240 is preserved for future use.

We claim:

1. A preservation device for a bottle having a neck comprising:

an upper member having a first side and a second side, opposite the first side, and a bore extending through the upper member, wherein the bore permits a flow of liquid;

a lower member disposed adjacent the second side of the upper member, the lower member being configured to fit within the neck of the bottle;

at least one sealing member extending around an outer surface of the lower member for substantially preventing the flow of liquid or air into or out of the bottle around the outer surface of the lower member when the lower member is disposed within the neck of the bottle;

at least one inlet disposed on the lower member below the sealing member, wherein the inlet is configured to allow the flow of a liquid or air into the lower member, and wherein the inlet is in communication with the bore;

an attachment member disposed on the lower member at an end distal to the upper member; and a detachable container for holding an oxygen absorber, the detachable container being configured to mate with the attachment member, the detachable container having at least one side wall having at least one aperture and a membrane attached to at least one side wall and extending across the at least one aperture, wherein the membrane is comprised of a material that is air permeable and liquid impermeable.

2. The preservation device of claim 1, further comprising a pour spout attached to the first side of the upper member and centered about the bore.

3. The preservation device of claim 1, wherein the at least one side wall of the detachable container has a plurality of apertures.

4. The preservation device of claim 1, wherein the at least one side wall of the detachable container has a cylindrical shape.

5. The preservation device of claim 4, wherein the at least one side wall of the detachable container is a mesh.

6. The preservation device of claim 5, wherein the mesh forms at least a portion of the cylindrically shaped side wall, and wherein the air permeable and liquid impermeable membrane is attached to and extends around a surface of the mesh.

7. The preservation device of claim 1, wherein the lower member includes a plurality of inlets, wherein each of the inlets is in communication with the bore.

8. The preservation device of claim 1, wherein the at least one sealing member is configured to fit inside the neck of the bottle.

9. The preservation device of claim 1, wherein the at least one inlet is an air vent disposed in a side wall of the lower member proximate to and above the detachable container.

10. The preservation device of claim 9, wherein the attachment member is disposed on the lower member below the air vent.

11. The preservation device of claim 9, wherein the air vent connects to an air channel extending from the air vent to an end of the upper member distal to the lower member.

12. The preservation device of claim 1, wherein the container holds a replaceable oxygen absorber.

13. A preservation device for use with a bottle having a neck comprising:

a first member having at least a flange configured to fit outside a neck of a bottle, and a tube configured to fit within the neck of the bottle;

a second member operably connected to the tube at an end of the tube distal to the flange, the second member having a side wall and configured to fit within the neck of the bottle;

at least one sealing member configured to fit inside the neck of the bottle and extending around an outer surface of the first member for substantially preventing the flow of liquid or air into or out of the bottle around the outer surface of the first member, when the first member is disposed within the neck of the bottle; and a container for holding an oxygen absorber, the container being detachably connected to an end of the second member distal to the first member, and the container having at least one side wall and at least one aperture and a membrane attached to the at least one side wall of the container and extending across the at least one aperture, wherein the membrane is comprised of a material that is air permeable and liquid impermeable.

14. The preservation device of claim 13, further comprising a liquid channel extending from a liquid inlet disposed in the side wall of the second member to an end of the tube distal to the second member and an air channel extending from an air vent disposed in the side wall of the second member to the end of the tube distal to the second member.

15. The preservation device of claim 14, wherein the end of the tube distal to the second member further comprises a pour spout.

16. The preservation device of claim 15, wherein the pour spout is at least in fluid communication with the liquid channel.

17. The preservation device of claim 15, further comprising a lid having a first side and a second side, wherein at least the second side of the lid is configured to fit within and substantially seal the pour spout.

18. The preservation device of claim 14, wherein the liquid channel comprises of a first liquid channel and a second liquid channel.

19. The preservation device of claim 14, wherein the air channel comprises of a first air channel and a second air channel.

20. The preservation device of claim 13, wherein the at least one sealing member is part of a seal support member which is dimensioned to fit over the outer diameter of the tube.

21. The preservation device of claim 14, wherein the liquid channel and the air channel are contained within the second member and the tube.

22. The preservation device of claim 21, wherein the air channel is enclosed separately from the liquid channel within the tube.

23. The preservation device of claim 14, wherein the air vent is disposed in the side wall of the second member at an end of the second member proximate to and above the container.

24. A preservation device for a bottle having a neck comprising:

an upper member having a first side and a second side, opposite the first side, and a bore extending through the upper member;

a lower member disposed adjacent the second side of the upper member, the lower member being configured to fit within the neck of the bottle;

at least one sealing member configured to fit at least a portion of the sealing member inside the neck of the bottle and extending around an outer surface of the lower member for substantially preventing the flow of liquid or air into or out of the bottle around the outer surface of the lower member when the lower member is disposed within the neck of the bottle;

at least one inlet disposed on the lower member below the sealing member, wherein the inlet is configured to allow the flow of a liquid or air into the lower member, and wherein the inlet is in communication with the bore;

an attachment member disposed on the lower member at an end of the lower member distal to the upper member; and a container for holding a replaceable oxygen absorber, the container being detachably connected to an end of the attachment member distal to the lower member, the container being configured to mate with the attachment member, the container having at least one side wall having at least one aperture and a membrane attached to the at least one side wall and extending across the at least one aperture, wherein the membrane is comprised of a material that is air permeable and liquid impermeable.

25. The preservation device of claim 24, wherein the bore permits a flow of liquid.

26. The preservation device of claim 24, wherein the at least one inlet disposed on the lower member is an air inlet connecting to an air channel, and wherein the air channel is separably enclosed and in communication with the bore.

27. The preservation device of claim 26, wherein the attachment member is disposed below the air inlet on the lower member.

28. A preservation device for use with a bottle having a neck comprising:

a first member having at least a flange configured to fit outside the neck of the bottle, and a tube configured to fit within the neck of the bottle;

a second member operably connected to the tube at an end of the tube distal to the flange, the second member having a side wall and configured to fit within the neck of the bottle;

an air vent disposed in the side wall of the second member at an end of the second member distal to the tube;

an air channel extending from the air vent to an end of the tube proximate to the flange, wherein the air channel is separably enclosed within the tube;

at least one sealing member extending around an outer surface of the first member for substantially preventing the flow of liquid or air into or out of the bottle around the outer surface of the first member, when the first member is disposed within the neck of the bottle; and a container for holding a replaceable oxygen absorber, the container being attached to an end of the second member distal to the first member, and the container having at least one side wall and at least one aperture, and a membrane attached to the at least one side wall of the container and extending across the at least one aperture, wherein the membrane is comprised of a material that is air permeable and liquid impermeable.

29. The preservation device of claim 28, wherein a portion of the tube is configured to permit a flow of liquid.

30. The preservation device of claim 28, wherein the at least one sealing member is configured to fit inside the neck of the bottle.

31. The preservation device of claim 28, wherein the container is a detachable container.

32. The preservation device of claim 28, wherein the air vent is disposed in a side wall of the second member at an end of the second member proximate to and above the container.

33. The preservation device of claim 28, further comprising a liquid channel extending from a liquid inlet disposed in the side wall of the second member, through the portion of the tube is configured to permit a flow of liquid, and to an end of the tube distal to the second member.

* * * * *